US006237917B1

(12) United States Patent
Timpano

(10) Patent No.: US 6,237,917 B1
(45) Date of Patent: May 29, 2001

(54) METHOD OF PLAYING A BACCARAT GAME

(76) Inventor: Michael Timpano, 364 Grenville Ave., Orillia, Ontario (CA), L3V 7P7

( * ) Notice: Subject to any disclaimer, the term of this patent is extended or adjusted under 35 U.S.C. 154(b) by 0 days.

(21) Appl. No.: 09/267,185

(22) Filed: Mar. 12, 1999

Related U.S. Application Data

(60) Provisional application No. 60/077,828, filed on Mar. 12, 1998.

(51) Int. Cl.[7] ..... A63F 1/00
(52) U.S. Cl. ..... 273/292
(58) Field of Search ..... 273/292, 274, 273/309; 463/12, 13

(56) References Cited

U.S. PATENT DOCUMENTS

| | | | | |
|---|---|---|---|---|
| 5,154,429 | | 10/1992 | LaVasseur | 273/292 |
| 5,257,810 | | 11/1993 | Schorr | 273/292 |
| 5,280,915 | | 1/1994 | Groussman | 273/292 |
| 5,322,295 | | 6/1994 | Cabot | 273/292 |
| 5,362,064 | * | 11/1994 | Lofink et al. | 273/292 |
| 5,397,128 | * | 3/1995 | Hesse et al. | 273/292 |
| 5,529,309 | * | 6/1996 | Bratlett | 273/292 |
| 5,732,949 | | 3/1998 | Josephs | 273/292 |

OTHER PUBLICATIONS

"Scarney Baccarat", Scarne's Encyclopedia of Games, John Scarne, Harper & Row Publishers, pp. 297–302, 1973.*
"California Baccarat", Comerce Casino, Casino Gaming Concepts, Inc., 1994.*
"California Baccarat", Casino Gaming Concepts, Inc., 1994.*

* cited by examiner

*Primary Examiner*—Benjamin H. Layno
(74) *Attorney, Agent, or Firm*—Philip J. Anderson; Robert Ryan Morishita; Anderson & Morishita

(57) ABSTRACT

A method for playing a Baccarat game in which players play against a dealer using a deck of conventional playing cards or electronic representations thereof. Each player wagers and is dealt two cards to form an initial hand. Any player receiving a pre-determined winning hand is rewarded and play is terminated for that player. Otherwise, the players may opt to take a single additional card to form a final hand. The value of each final hand is determined by summing the value of each card in the final hand modulo ten, wherein face cards and tens have a value of zero, Aces have a value of one, and all other cards have a value equal to their numeric face value. The wager is collected from each player receiving a pre-determined losing hand and play is terminated as to that player. A dealer's initial hand of two cards is dealt and evaluated. If the value of the dealer's initial hand is within a pre-determined range, the dealer must take an additional card. The value of the dealer's final hand is compared to the value of each player's final hand. Wagers are resolved by rewarding players having a higher final hand value than the dealer's final hand value, collecting wagers from players having a final hand value less than the dealer's final hand value, and returning wagers on ties.

17 Claims, 1 Drawing Sheet

METHOD OF PLAYING A BACCARAT GAME

RELATED APPLICATIONS

The present invention claims the benefit of United States Provisional Application 60/077,828 filed Mar. 12, 1998.

FIELD OF THE INVENTION

The present invention relates to casino table and electronic-format card games such as Poker, Blackjack and Baccarat.

BACKGROUND

Card games such as Poker and Baccarat are well known forms of casino-type games. They provide excitement and entertainment to the players. In these games the players are looking for a game in which they have a reasonable chance of winning their wager and the casinos are looking for a reasonable return for hosting the game.

Baccarat is one of the many live table games played in casinos or gaming establishments. Baccarat uses a standard deck of fifty-two playing cards and is usually dealt from a shoe having multiple decks that have been shuffled together prior to the beginning of play.

The object of the game of Baccarat is for the bettor to successfully wager on whether the Bank's hand or the Player's hand is going to win. The bettor receives even money for his wager if he selects the winning hand and loses his wager if he selects the losing hand. Because of the rules of play of Baccarat, and more particularly the pre-established draw rules, the Bank's hand has a slightly higher chance of winning than does the Player's hand. The winning frequency for the Bank's hand has been determined to be 0.45859 (45.859%) whereas the winning frequency for the Player hand is 0.44624 (44.624%) with the remainder of the outcomes being ties. Therefore, if the bettor wagers on the Bank's hand and the Bank hand wins, the bettor must pay to the gaming establishment a commission (typically, 5%) of the amount the bettor wins. No commission is paid if the bettor successfully wagers on the Player's hand.

As used in this specification, the term "Conventional Manner of Play of Baccarat" is as follows:

A multiple number of decks of standard playing cards, 52 in number, are used; typically eight decks are shuffled together and placed in a shoe from which the cards are dealt during the play of the game.

Each bettor makes a wager on whether the Bank's hand or the Player's hand will win. After all wagers are made, two cards are dealt from the shoe to the Bank position and two cards are dealt from the shoe to the Player position on the table layout. The cards are turned face up and the value of the Bank hand the Player hand is determined, modulo ten.

Aces count one; Kings, Queens, Jacks and Tens count zero and the other cards count their respective face value. The suits (Spades, Hearts, Diamonds and Clubs) have no meaning in Baccarat.

The highest hand value in Baccarat is nine. All hand values range from a low of zero to a high of nine. If when the cards are added together, the total of the hand exceeds nine, then the hand value is determined modulo ten. For example, a seven and a eight total fifteen, but the hand value is five. An Ace and a nine total ten, but the hand value is zero.

A two card total of eight or nine is called a "natural"; a two card total of zero is called a "baccarat." As will be explained below, in certain situations in the play of the game, a third card will be dealt. The value of this third card is added to the total of the first two cards and a new hand value is established. Again, if the new hand total exceeds nine, the hand value is determined by subtracting ten from the total of the hand.

Prior to the deal, each better can make one of three wagers: 1) that the Bank hand will win; 2) that the Player hand will win; or 3) that the Bank hand and the Player hand will tie. Wagering locations are provided on the Baccarat table layout. Whichever of the Bank hand or the Player hand is closest to a total of nine is the winner.

All winning Bank hand wagers are paid off at odds of one-to-one and the house charges a five percent (5%) commission on the amount won by the bettor. For example, if a bettor wagers $100 on the Bank hand and the Bank hand wins, the bettor wins $100 and is charged a $5 commission on the amount that the bettor won. The bettor is not charged any commission on the amount of his wager.

All winning Player hand wagers are paid off at odds of one-to-one and the bettor is not charged any commission on the amount of his winnings or his wager because the house, by virtue of the third card draw rules, has a statistical advantage over the player of 45.859–44.624 or 1.235% which is the vigorish ("vig") of the house on player wagers. Winning wagers on the Tie hand bet are paid off at odds of nine-to-one or eight-to-one (depending on the gaming establishment) and the bettor is not charged any commission on the amount of his winnings or his wager since there is already a statistical advantage in favor of the house on tie wagers. If a Tie hand occurs, all wagers on the Bank hand and all wagers on the Player hand are "pushes" and the amount wagered is returned to the bettor.

Depending on the point total of the Player's hand and the Dealer's hand, one more card may be dealt to either the Player's hand, the Dealer's hand or both. The rules for determining whether a third card is dealt are fixed; that is, there is no discretion for either the Player's hand or the Dealer's hand on whether a third card is dealt.

If either the Player hand or the Dealer hand has a point total of eight or nine on the first two cards, no third card is dealt to either hand and the hand with the highest point total is the winner (or a Tie, as the case may be). If neither the Player hand nor the Dealer hand has a point total of eight or nine, then there is a possibility of a third card draw.

The third card draw rules are as follows:

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule #2: If the Player hand stands and does not draw a third card, then the Bank hand follows Rule #1. In other words, if the Player hand has a point total of 6 or 7, the Bank hand draws a third card on a point total of 0, 1, 2, 3, 4 or 5 and the Bank hand stands on a point total of 6 or 7.

Rule #3: If the Player hand draws a third card, the Bank hand must draw or stand as follows:

| Bank hand two card point total: | Bank hand DRAWS when the Player's hand third card is: | Bank hand STANDS when the Player's hand third card is: |
|---|---|---|
| 0, 1, or 2 | Bank always draws | |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | | Bank always stands |

The draw rules for Conventional baccarat are shown in Table 1 below.

TABLE 1

| BACCARAT RULES PLAYER | |
|---|---|
| HAVING TWO CARD TOTAL OF | |
| 0–1–2–3–4–5 | DRAWS A CARD |
| 6–7 | STANDS |
| 8–9 | TURNS CARDS OVER |

| BANKER | | |
|---|---|---|
| HAVING TWO CARD TOTAL OF | DRAWS WHEN GIVING OR PLAYER'S THIRD CARD DRAW IS AN | DOES NOT DRAW WHEN GIVING OR PLAYER'S THIRD CARD DRAW IS AN |
| 0–1–2 | ALWAYS DRAWS | |
| 3 | 1–2–3–4–5–6–7–9–10 | 8 |
| 4 | 2–3–4–5–6–7 | 1–8–9–10 |
| 5 | 4–5–6–7 | 1–2–3–8–9–10 |
| 6 | 6–7 | 1–2–3–4–5–8–9–10 |
| 7 | STANDS | |
| 8–9 | TURNS CARDS OVER | |

At the end of each hand, winning wagers are paid and losing wagers are collected by the house. Any commission due to the house is marked in commission boxes in the center of the table. Gaming chips are used to represent the amount of money owed by each bettor to the house for the commissions. In order not to slow down the game, the commission is not actually collected from each bettor until the end of the round determined by all of the cards in the shoe being dealt down to the plastic cut card, usually approximately eighty hands.

The mathematical analysis of the game reveals that the 5% commission is what gives the house its advantage on wagers on the Banker hand and allows the gaming establishment to make a profit from providing the Baccarat game to the bettors. Because the rules for standing and drawing third cards are automatic, the mathematical analysis shows that the Bank hand will win 45.859% of the hands, the Player hand will win 44.624% of the hands and the Tie hand will occur 9.517% of the hands. If the Tie hands are disregarded because they do not affect any Player or Bank wagers, it is then determined that the Bank hand will win 50.7% of the time and the Player hand will win 49.3% of the time.

Because the Bank hand wins more than 50% of the hands (disregarding the Tie hands that do not affect any Player or Bank wagers), if a bettor always bet on the Bank hand, the bettor would have an advantage over the gaming establishment. By charging a 5% commission on all Bank hand wins, the gaming establishment compensates for the percentage of winning Bank hands being slightly over 50%.

After figuring in the 5% commission that must be paid by bettors on winning Bank hands, the gaming establishment has approximately a 1.23% advantage over the bettor when the bettor wagers on the Player hand and the gaming establishment has a 1.057% advantage over the bettor when the bettor wagers on the Bank hand. The Tie hand wager gives the gaming establishment a 4.88% advantage over the bettor when the payoff odds are nine-to-one and a 14.1% advantage over the bettor when the payoff odds are eight-to-one.

There is a need for a new Baccarat game which each player to play his or her own, individual hand instead of requiring all players to use a single, common player hand; which provides for the player to opt to draw a third card without regard to the initial two card total for the player's hand; and which provides the player with the opportunity to receive a greater payout with respect to his or her hand. This new game would provide the players with greater excitement in that they would feel that each player has some control over his or her hand. From the casino standpoint, this new game, because of the opportunities provided thereby and the attraction to the players, would increase the drop (amount wagered per unit time) for the table.

SUMMARY OF THE INVENTION

One embodiment of the present invention is method for playing a casino game in which at least one player plays against a dealer using at least one deck of conventional playing cards. In an alternate embodiment, the game is played on an apparatus using electronic representations of at least one deck of conventional playing cards.

The game begins with each player placing a wager. Two cards are dealt to each player to form an initial hand. Any player receiving a pre-determined winning initial hand, two nines for example, is rewarded and play is terminated for that player. In a preferred embodiment, each player winning with a pre-determined winning initial hand is rewarded at three-to-two on the player's wager.

Each player may examine his or her hand and determine the value of each the initial hand by summing the value of each card in the final hand modulo ten, wherein Kings, Queens, Jacks, and tens have a value of zero, Aces have a value of one, and all other cards have a value equal to their numeric face value. Each player may then opt to receive a single additional card. If the player opts to receive an additional card, the player's final hand consists of the player's initial hand plus the additional card. If the player does not opt to receive an additional card, the player's final hand consists of the player's initial hand.

Two cards are dealt to the dealer (face down) and to each player. The dealer reveals the dealer's initial hand after all the players have completed their final hands. The value of the dealer's initial hand is calculated. An additional card is dealt to the dealer if the dealer's initial hand is within a predetermined range, 0–5 for example. If the dealer receives an additional card, the dealer's final hand consists of the dealer's initial hand plus the additional card. If the dealer does not receive an additional card, the dealers final hand is equal to the dealer's initial hand.

The dealer's final hand value is compared to each player's final hand value and each wager is resolved by rewarding wagers for each player having a higher final hand value than the dealer's final hand value, collecting wagers from each player having a final hand value less than the dealer's final hand value, and returning wagers (i.e. a push) to players having a final hand value equal to the dealer's final hand value. In one embodiment, the dealer retains a percentage of the player's reward as a commission. In an alternate embodiment, each player places a commission amount on the layout adjacent the player's wager. The commission amount is collected from winning players and returned to losing players.

It is an object of the invention to provide a game in which, unlike Baccarat, a player has control over when to draw cards. Another object of the invention is to provide a game which is easy to learn.

BRIEF DESCRIPTION OF THE DRAWING

These and other features and advantages of the method for playing the game will become better understood with reference to the description and drawing which depicts a layout for the play of the game.

DESCRIPTION

Figure 1:
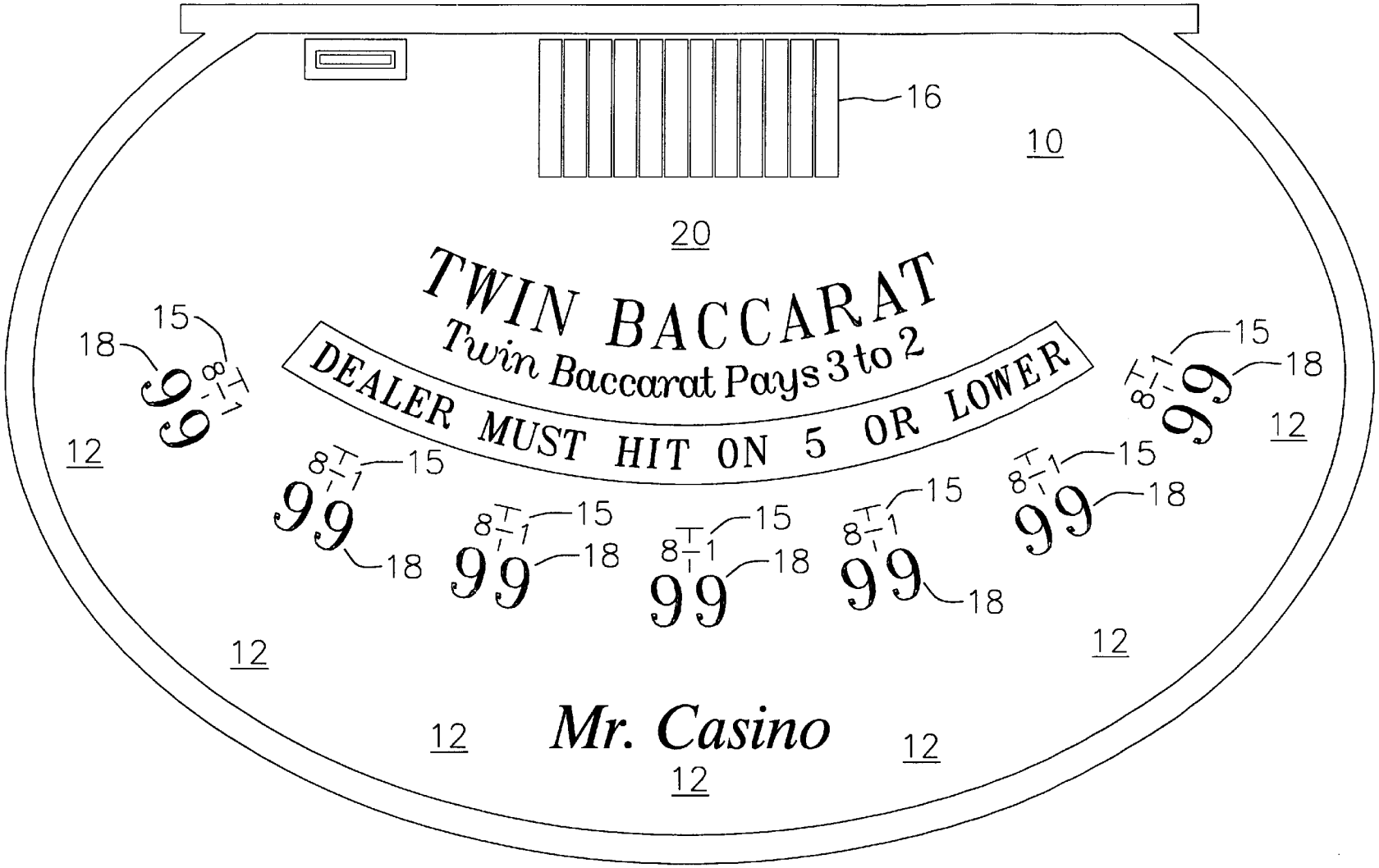

Turning to the drawing, a table layout 10 is shown which includes seven player positions 12 spaced about the layout 10. Opposite the player positions 12 is a dealer position 14 having thereat a check tray 16 to hold the gaming tokens or chips paid out and received during play of the game. Each player position 12 may be denoted by indicia 18 which may be the logo of the casino or, as shown, the numerals "99". Between the player positions 12 is an action area 20 where the dealer places his/her cards during the play of the game.

With the layout 10 described, the method for the play of the game will now be set forth.

Each player places the player's wager at the indicia 18 associated with the player's position 12. In a preferred embodiment, players additionally place a commission amount equal to five percent of their wager adjacent to their wager. This commission amount is collected by the dealer from winning players and returned to losing players. As described hereinafter, each player is wagering that the player's hand value is higher (closer to nine) than the dealer's hand value. Players may also wager on a tie, that is, that the player's hand value will be equal to the dealer's hand value, by placing a tie wager on a tie area 15, indicated by a "T" symbol, above the indicia 18 associated with the player's position 12. This wager is preferably paid at eight to one. After all players have made their wagers, the dealer deals to each player, in sequence, a first card face up and then a second card also face up. The values of the cards are summed, as in conventional Baccarat, modulo ten with face cards counting ten (or zero), Aces counting one and all other cards having their face values, to define an value for each player's initial hand. Based upon the value of their initial hand each player is provided with the option to stand or to take a third card. If the player stands, the value of the initial hand becomes the player's final hand value. If the player takes a third card, that card is dealt by the dealer face up and is summed with the cards of the initial hand, modulo ten, to determine a final value for the player's hand.

If any player has a final hand value of zero, according to a first embodiment, that is deemed a losing outcome and the player's wager is immediately collected and the player's cards are removed from the layout 10.

If the player's initial two cards were two 9s, e.g. a 9 of spades and a 9 of diamonds, this is referred to as a Twin Baccarat, which is deemed the highest holding for the game, and the player is immediately paid at least 3:2 based upon their wager, no commission is collected, and the player's cards are collected.

After all the player's have completed their hands, the dealer reveals his initial hand by turning his two cards face up in the action area 20. The values of the initial cards are summed, modulo ten, to determine an initial value for the dealer's initial hand. If the initial hand value is 0–5, the dealer must deal a third card face up into the action area 20 which is summed with the initial cards, modulo ten, to determine the dealer's final hand value. If the initial value is 6–9, the dealer stands and the initial value is the final dealer hand value.

The dealer's final hand value is then resolved against each of the player's final hand values. If the dealer's final value is less than that for the player, the player is declared the winner and they are paid even money, less a five percent commission retained by the casino. If the dealer's final hand value is greater than that of the player, the dealer is declared the winner and the player's wager and cards are collected. If the player's hand and the dealer's hand have the same final value, they are declared a tie or "push" and the player's wager is neither lost or won.

If the dealer's initial cards are a Twin Baccarat (a pair of 9s), the dealer is declared the winner over all remaining player hands inasmuch as the Twin Baccarat is the highest holding.

The game according to the method may be played using multiple decks such as an eight deck shoe. It has been determined that the method of the game according to this embodiment results in a game having a statistical house advantage of about 1.9%.

The methods of the play of the game can be incorporated into an electronic gaming machine. The machine has a processor which has a data structure including data representing each of the cards of a deck of cards. The player inputs their wager and initiates play whereupon the processor randomly selects and displays two player cards face up and two dealer cards face down. If the player has a Twin Baccarat they are immediately paid at odds of, for example, 3:2. The player opts to draw a third card to obtain a final value. Thereafter the dealer's hand is exposed and the dealer action is as described above, i.e. the processor assesses the dealer's cards for a Twin Baccarat, sums the dealer's cards modulo ten and draws a third card if the initial value is 0–5. The hands are then compared and player winning wagers are assessed a commission, which may be indicated by the processor as holding a token, dealer winning outcomes result in the player losing their wager and tie outcomes resulting in a push.

I claim:

1. A method for playing a casino game in which at least one player plays against a dealer using at least one deck of conventional playing cards, comprising each player placing a wager;

dealing two cards to each player and the dealer to form an initial hand, the dealer's cards being dealt face down;

rewarding the wager from each player having predetermined winning hand in the player's initial hand of a pair of nines and terminating play for those players;

determining the value of each player's initial hand by summing the value of each card in the final hand modulo ten, wherein Kings, Queens, Jacks, and tens have a value of zero, Aces have a value of one, and all other cards have a value equal to their numeric face value;

each player opting to receive a single additional card, whereby each player who does not receive an additional card has a final hand equal to the player's initial hand and each player who receives an additional card has a final hand equal to the player's initial hand plus the additional card;

revealing the dealer's initial hand;

determining the value of the dealer's initial hand;

dealing an additional card to the dealer if the dealer's initial hand is a first pre-determined value, whereby if the dealer does not receive an additional card, the dealer's final hand is equal to the dealer's initial hand and if the dealer receives an additional card, the dealer's final hand is equal to the dealer's initial hand plus the additional card;

comparing the dealer's final hand value to each player's final hand value; and resolving each wager by rewarding wagers from each player having a higher final hand value than the dealer's final hand value, collecting wagers from each player having a final hand value less than the dealer's final hand value, and returning wagers to players having a final hand value equal to the dealer's final hand value.

2. The casino game of claim 1 additionally comprising collecting the wager from each player having a pre-determined losing hand in the player's final hand and terminating play for those players.

3. The casino game of claim 2 wherein the pre-determined losing hand is a hand with a value of zero.

4. The casino game of claim 1 wherein the step of rewarding the pre-determined winning hands includes paying the winning player at three-to-two on the player's wager.

5. The casino game of claim 1 further comprising the step of each player placing a commission amount on the layout wherein the commission amount is collected from winning players and returned to losing players.

6. The casino game of claim 1 wherein the step of wagering additionally comprises allowing each player to place a tie wager wherein said tie wager is rewarded if the player's final hand value equals the dealer's final hand value and is collected if the player's final hand value is not equal to the dealer's final hand value.

7. A method for playing a casino game in which at least one player plays against a dealer using at least one deck of conventional playing cards, comprising each player placing a wager;

dealing two cards to each player to form a initial hand;

rewarding the wager from each player having pre-determined winning hand in the player's initial hand and terminating play for those winning players;

determining the value of each player's initial hand by summing the value of each card in the final hand modulo ten, wherein Kings, Queens, Jacks, and tens have a value of zero, Aces have a value of one, and all other cards have a value equal to their numeric face value;

each player opting to receive a single additional card, whereby each player who does not receive an additional card has a final hand equal to the player's initial hand and each player who receives an additional card has a final hand equal to the player's initial hand plus the additional card;

collecting the wager from each player having a pre-determined losing hand in the player's final hand and terminating play for those losing players;

dealing two cards to the dealer to form an initial hand;

determining the value of the dealer's initial hand;

dealing an additional card to the dealer if the dealer's initial hand is a first pre-determined value, whereby if the dealer does not receive an additional card, the dealer's final hand is equal to the dealer's initial hand and if the dealer receives an additional card, the dealer's final hand is equal to the dealer's initial hand plus the additional card;

comparing the dealer's final hand value to each player's final hand value; and resolving each wager by rewarding wagers from each player having a higher final hand value than the dealer's final hand value, collecting wagers from each player having a final hand value less than the dealer's final hand value, and neither rewarding nor collecting wagers from players having a final hand value equal to the dealer's final hand value.

8. The casino game of claim 7 additionally comprising collecting the wager from each player having a pre-determined losing hand in the player's final hand and terminating play for those players.

9. The casino game of claim 7 wherein the pre-determined losing hand is a hand with a value of zero.

10. The casino game of claim 7 wherein the pre-determined winning hand is a hand with a pair of nines.

11. The casino game of claim 7 wherein the step of rewarding the pre-determined winning hands includes paying the winning player at three-to-two on the player's wager.

12. The casino game of claim 7 further comprising the step of each player placing a commission amount on the layout wherein the commission amount is collected from winning players and returned to losing players.

13. An apparatus for playing a casino game in which a player plays against a casino using electronic representations of at least one deck of cards, comprising:

a display;

a processor in communication with said display, said processor having a data structure storing data representing each of the cards;

means for issuing rewards to the player;

means for accepting wagers from the player in communication with said processor;

means for initiating play in communication with said processor, whereby when a player makes a wager and initiates play, said processor randomly selects and displays two player cards face up and two dealer cards face down for an initial holding for a hand of play, said processor issuing a reward to the player and terminating play if the player has received a pre-determined winning hand of a pair of nines; and means for the player to input a command to the processor to direct the processor to draw a single additional card, whereby if the player opts to draw an additional card, the player's final hand consists of the player's initial hand plus the additional card, otherwise, the player's final hand consists of the player's initial hand, said processor computing the value of the player's final hand by summing the value of each card in the final hand modulo ten, wherein Kings, Queens, Jacks, and tens have a value of zero, Aces have a value of one, and all other cards have a value equal to their numeric face value, said processor revealing the dealer's cards and computing the initial hand value of the dealer's cards, said processor drawing a single additional card if the dealer's initial hand value is within a pre-determined range, whereby if an additional card is drawn by the dealer, the dealer's final hand consists of the dealer's initial hand plus the additional card, otherwise, the dealer's final hand consists of the dealer's initial hand, said processor comparing the dealer's final hand value and the player's final hand value and issuing a reward to the player if the player's final hand value is greater than the dealer's final hand value, collecting the player's wager if the player's final hand value is less than the dealer's final hand value, and returning the player's wager if the player's final hand value equals the dealer's final hand value.

14. The apparatus of claim 13 wherein said processor collects the wager from each player having a pre-determined losing hand in the player's final hand and terminating play for those players.

15. The apparatus of claim 13 wherein the pre-determined losing hand is a hand with a value of zero.

16. The apparatus of claim 13 wherein each player having a pre-determined winning hands is paid at three-to-two on the player's wager.

17. The apparatus of claim 13 wherein the processor retains a percentage of each winning player's reward as a commission.

* * * * *